US006266392B1

(12) United States Patent
Fujinawa et al.

(10) Patent No.: US 6,266,392 B1
(45) Date of Patent: Jul. 24, 2001

(54) SOLLER SLIT AND MANUFACTURING METHOD OF THE SAME

(75) Inventors: Go Fujinawa; Shiro Umegaki, both of Tokyo (JP)

(73) Assignee: Rigaku Corporation, Akishima (JP)

( * ) Notice: Subject to any disclaimer, the term of this patent is extended or adjusted under 35 U.S.C. 154(b) by 0 days.

(21) Appl. No.: 09/427,617

(22) Filed: Oct. 27, 1999

(30) Foreign Application Priority Data

Nov. 2, 1998 (JP) ..... 10-311935

(51) Int. Cl.[7] ..... G21K 1/02
(52) U.S. Cl. ..... 378/149; 378/145; 378/147
(58) Field of Search ..... 378/84, 85, 145, 378/147, 149

(56) References Cited

U.S. PATENT DOCUMENTS 4,856,043 * 8/1989 Zola ..... 378/149
5,016,267 * 5/1991 Wilkins ..... 378/84
6,049,588 * 4/2000 Cash, Jr. ..... 378/85
6,108,401 * 8/2000 Reefman ..... 378/83

OTHER PUBLICATIONS

B.D. Cullity. Elements of X–Ray Diffraction, second edition (Reading, MA: Addision–Wesley, 1978), p. 196–199.*

* cited by examiner

*Primary Examiner*—Robert H. Kim
*Assistant Examiner*—Allen C. Ho
(74) *Attorney, Agent, or Firm*—Burns, Doane, Swecker & Mathis, LLP

(57) ABSTRACT

A soller slit is disclosed, which includes a plurality of metal foils and functions to restrict divergence of X-rays when arranged on an X-ray optical path. The metal foils are prepared by sintering a metal material such that surface thereof have high harmonic surface roughness. Alternatively, the metal foil has oxides formed by oxidation on the surfaces thereof such that the oxides can provide the high harmonic surface roughness. The high harmonic surface roughness of the metal foil restricts total reflection of X-rays at the metal foil. Therefore, it is possible to form high precision parallel X-ray beams by the soller slit to thereby improve resolution in an X-ray measurement.

10 Claims, 7 Drawing Sheets

SOLLER SLIT AND MANUFACTURING METHOD OF THE SAME

BACKGROUND OF THE INVENTION

1. Field of the Invention

The present invention relates to a soller slit used in an X-ray device, etc., for collimating diverging X-rays to parallel X-rays and a manufacturing method of the same soller slit.

2. Description of the Related Art

In general, a soller slit is constructed by piling up a plurality of thin metal foils with interposing a spacer therebetween and is used in an X-ray optical system to restrict vertical and/or horizontal divergence of X-rays. The metal foils of the conventional soller slit may be formed from rolled stainless steal or brass (Cu-Zn) and the like.

However, since such rolled metal foil has a mirror-surfaces, incident X-rays R1 are totally reflected thereby as shown in FIG. 7, so that it is impossible to obtain parallel X-ray beams having required precision to thereby obtain an aimed resolution in an X-ray measurement. Particularly, in a case where the aimed resolution is not more than the critical angle for wavelength of incident X-rays at which total reflection occur, a divergence of X-rays due to total reflection becomes substantially equal to or more than the resolution, causing a big problem.

In order to restrict the total reflection, it has been usual, for example, to rough the surfaces of the metal foils by emery papers, to etch them with using acid, and to plate them. However, in any of the conventional roughing techniques, satisfactory high precision parallel X-ray beams, and thus, high resolution has not been obtained.

SUMMARY OF THE INVENTION

The present invention was made in view of the above mentioned state of art and has an object to provide a soller slit capable of forming parallel X-ray beams with high precision and improving resolution in an X-ray measurement.

According to the present invention, the above object can be achieved by a soller slit that is featured by the following matters:

(1) A soller slit comprising a plurality of metal foils stacked with a constant interval between adjacent foils and having a function to restrict divergence of X-rays when arranged on an X-ray optical path, is featured by that each metal foil is formed by sintering a metal material such that surfaces of the metal foil have high harmonic surface roughness.

In this specification, the term "high harmonic surface roughness" means the roughness of surface having a repetition of irregularity at short period, like high frequency vibration. In detail, the surface of the metal foil is smoother than a surface having a repetition of irregularity at long period like a surface roughed by emery finishing, by etching with acid etc., and is rougher than a super smooth surface such as a glass surface. In more detail, it is the surface roughness enough to prevent total reflection of X-rays from occurring.

The term "sintering" has the usual meaning. That is, a metal foil prepared by sintering a material can reliably provide high harmonic surface roughness within the required roughness range. The sintering is a still developing technology and it has been known that the surface roughness of a metal foil prepared by sintering a metal material with using the conventional sintering technology is considerable and it is difficult to provide the high harmonic surface required in the present invention. Recently, however, it becomes possible to provide such surface roughness as required in the present invention, by the sintering technology.

In view of the recent development of the sintering technology, it may be possible to form an ultra smooth surface condition close to a mirror surface having space period not larger than several tens $\mu$m and root mean square (RMS) value not larger than several tens nm(nanometer) by a sintering processing. In such case, however, a resultant ultra smooth surface might be outside the high harmonic surface condition required in the present invention.

In the soller slit according to the present invention, it is possible to prevent X-rays incident to the soller slit from being totally reflected on metal foils since metal foils have a high harmonic surface roughness. Thus, high precise parallel X-ray beams can be obtained, to thereby improve resolution in the X-ray measurement.

(2) Surface roughness of the metal foil and the like can be generally defined by the space period of X-rays and the RMS value (that is, mean amplitude of X-rays). A relatively rough surface obtainable by emery finishing and the like usually has a surface roughness defined by space period of 0.~1 mm and by RMS value of 0.1~1 $\mu$m. Also, an ultra smooth surface of a product such as a silicon substrate or a plate glass usually have a roughness defined by space period not larger than 25 $\mu$m and by RMS value of about 0.2 nm.

The high harmonic surface roughness in the present invention corresponds to surface roughness having space period of, for example not larger than 50 $\mu$m, preferably 20~50 $\mu$m and RMS value of, for example 20 nm~1 $\mu$m, preferably 20~50 nm, with which total reflection of X-rays can be prevented. Particularly, in order to obtain the effect expected in the present invention, it is considered as necessary to set RMS value within the above mentioned range.

(3) In the above-mentioned construction, the material forming the metal foil is not limited to any specific material. However, it may be preferably tungsten or molybdenum and the like.

(4) Another soller slit according to the present invention, which includes a plurality of metal foils stacked with a constant interval between adjacent foils and functions to restrict divergence of X-rays when the soller slit is arranged on an X-ray optical path, is featured by that each metal foil has oxide material formed on surface thereof by an oxidation processing and having high harmonic surface roughness.

Since the metal foils of the soller slit have high harmonic surface roughness, it is possible to restrict total reflection of X-rays incident on the soller slit, so that it becomes possible to form high precision parallel X-ray beams, to thereby improve resolution in the X-ray measurement.

Further, since the compound that is lighter in mass than the metal foil exists on the surfaces of the metal foil, another effect of reducing the critical angle for total reflection can be obtained.

Incidentally, the term "oxidation processing" means a processing for forming oxides on the surfaces of the metal foil, which is different from the etching processing for etching the surfaces of the metal foil. Etching processing cannot produce high harmonic surface roughness required in the present invention.

(5) In the construction of the soller slit mentioned in the paragraph (4), high harmonic surface roughness preferably has RMS value of 20 nm~1 $\mu$m, more preferably 20 nm~50 nm.

(6) In the construction of the soller slit mentioned in the paragraph (4), the material of the metal foil is not limited to any specific metal. For example, it may be brass or stainless steal, etc. In a case where brass is used as the material of the metal foil, using dense nitric acid or permanganate and the like can perform the oxidation processing. Also, in a case of employing a stainless steal, the oxidation processing using nitric acid may be difficult, since an oxide layer is formed on the surface of the metal foil and prevents further oxidation from occurring.

(7) A first method according to the present invention for manufacturing a soller slit including a plurality of metal foils stacked with a constant interval between adjacent ones of the metal foils, said soller slit being arranged on an X-ray optical path to restrict divergence of X-rays, wherein the metal foils are prepared by sintering a metal material such that surfaces thereof have high harmonic surface roughness.

According to this method, it is possible to collimate diverging X-rays to high precision parallel X-ray beams by preventing X-rays incident on the surfaces from being reflected totally to thereby improve resolution in the X-ray measurement.

(8) A second method according to the present invention for manufacturing a soller slit including a plurality of metal foils stacked with a constant interval between adjacent ones of the metal foils, said soller slit being arranged on an X-ray optical path to restrict divergence of X-rays, wherein oxide material is formed on both surface of each said metal foil by oxidizing said metal foil and said oxide material has high harmonic surface roughness.

According to the second method, it is also possible to form high precision parallel X-ray beams by preventing X-rays incident on the surfaces from being reflected totally to thereby improve resolution in the X-ray measurement.

DETAILED DESCRIPTION OF THE PREFERRED EMBODIMENTS

An embodiment of the soller slit according to the present invention will be described. Before describing the soller slit of the present invention in detail, the utilization of the soller slit will be described briefly.

Figure 5:
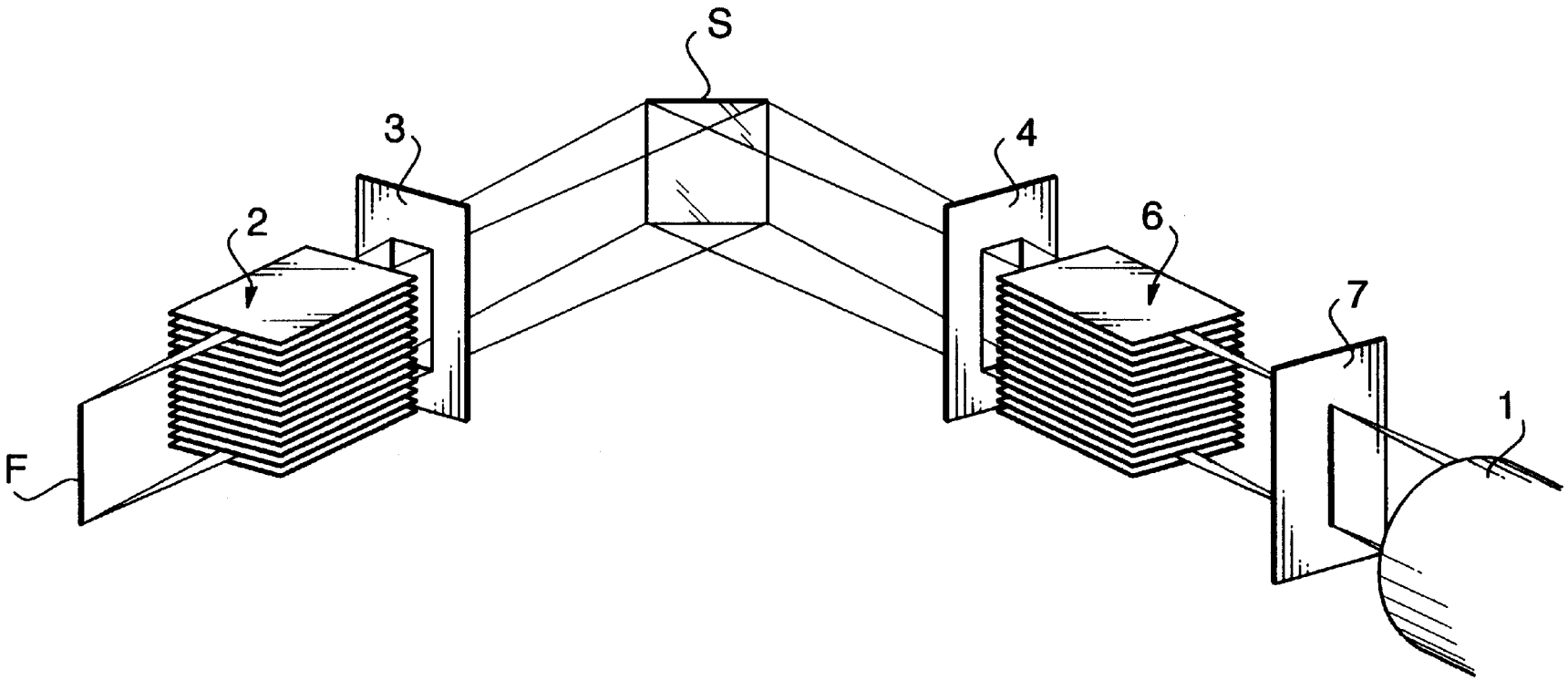
FIG. 5 is a perspective view of an example of an X-ray device utilizing the soller slit.

FIG. 5 illustrates a focusing type X-ray optical system that is an example of utilization of the soller slit. The X-ray optical system includes an X-ray focus 'F' of a line type generating X-rays, a specimen 'S' to be measured and an X-ray counter 1 for detecting X-rays diffracted by the specimen 's'. An incident side soller slit 2 and a divergence limiting slit 3 are arranged in the order between the X-ray focus 'F' and the specimen 's'. A scatter limiting slit 4, a receiving side soller slit 6 and a receiving slit 7 are arranged in the order between the specimen 'S' and the X-ray counter 1.

Divergent X-rays generated from the X-ray focus 'F' are directed to the incident side soller slit 2 to restrict divergence thereof in a vertical direction, that is height direction. The X-rays are subsequently incident on the divergence limiting slit 3 by which divergence thereof in a horizontal direction, that is width direction, is restricted. Then, the X-rays whose vertical and horizontal divergences are thus restricted are directed to the specimen 'S'. When Bragg's diffraction condition is satisfied between crystal lattice plane of the specimen 'S' and the incident X-rays, the X-rays are diffracted by the specimen 'S'.

X-rays diffracted by the specimen 'S' passes through the scatter limiting slit 4 to remove scattered component thereof, and then through the receiving side soller slit 6 to limit divergence thereof in the height direction. Then, the diffracted X-rays are focused on the receiving slit 7. Portions of the focused diffracted X-rays that fall in areas defined by the receiving slit 7 passes therethrough and are received by the X-ray counter 1 to thereby calculate an intensity of X-rays.

In the X-ray measurement mentioned above, it has been known that, when an X-ray component diverging in the height direction is taken in the X-ray counter 1, the so-called umbrella effect occurs, with which resolution is degraded. In order to avoid the degradation of resolution, the soller slits 2 and 6 prevent such X-ray component diverging in the height direction from being taken in the X-ray counter 1.

Figure 6:
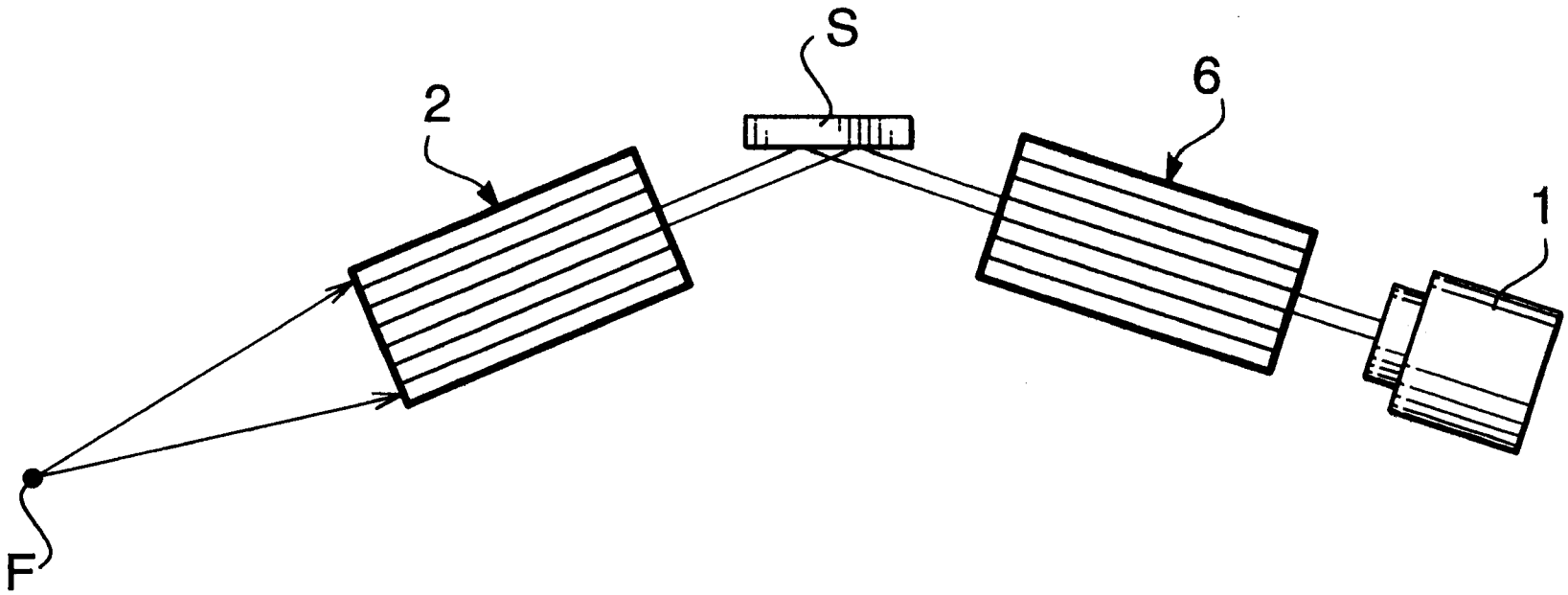
FIG. 6 is a perspective view of another example of an X-ray device utilizing the soller slit.
Figure 7:
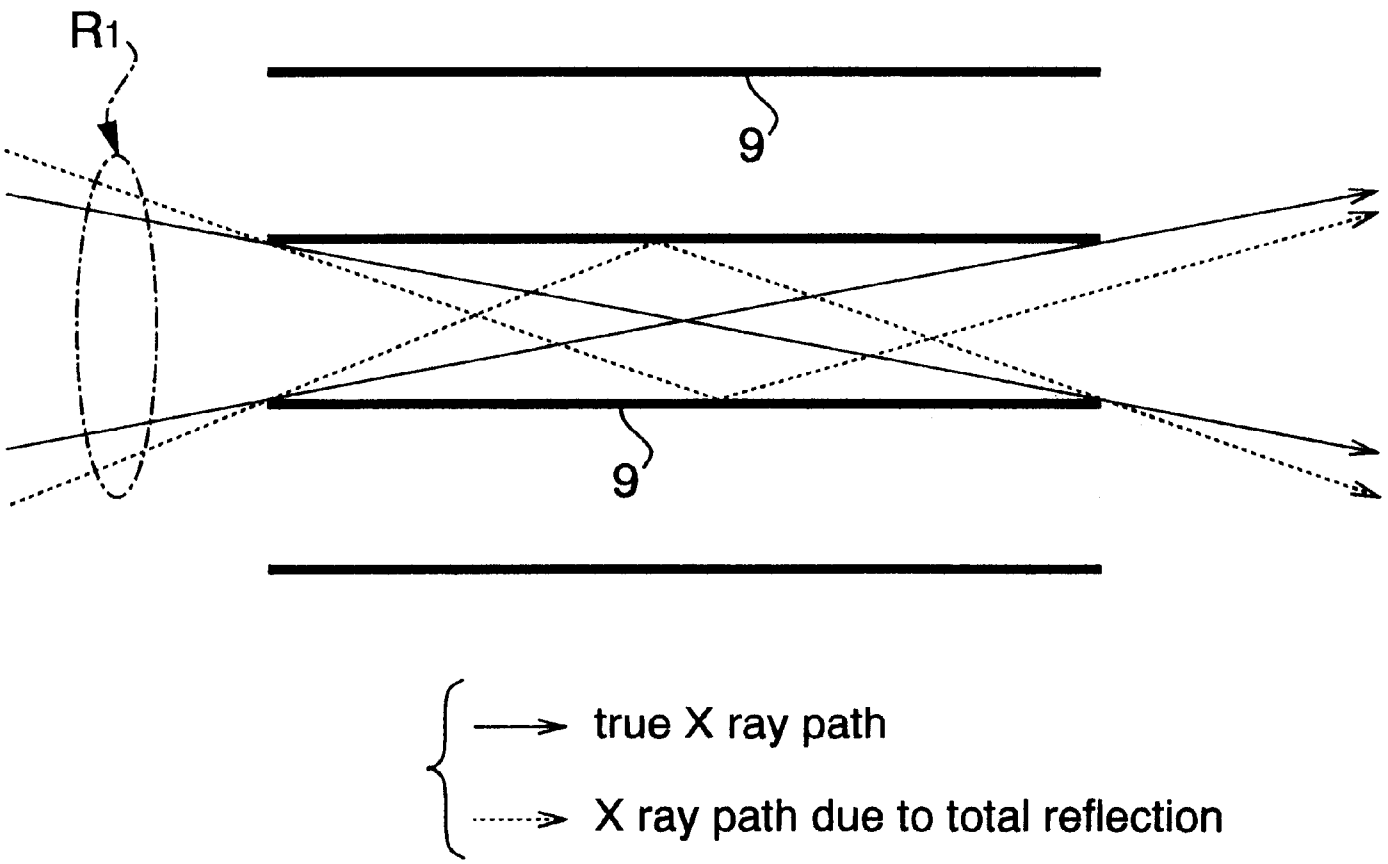
FIG. 7 illustrates propagation of X-rays within the soller slit.

FIG. 6 is a plan view of a parallel X-ray beam optical system that is another example of the utilization of the soller slit. This X-ray optical system includes an X-ray focus 'F' of a line type generating X-rays, a specimen 'S' to be measured and the X-ray counter 1 for detecting X-rays diffracted by the specimen 'S'. An incident side soller slit 2 is arranged between the X-ray focus 'F' and the specimen 'S'. A receiving side soller slit 6 is arranged between the specimen 'S' and the X-ray counter 1.

Divergent X-rays generated from the X-ray focus 'F' are transformed into parallel beams by the incident side soller slit 2 and is incident on the specimen 'S'. X-rays diffracted by the specimen 'S' is received in the X-ray counter 1 while its divergence is restricted by the receiving soller slit 6. And then, intensity of X-rays is calculated. The receiving side soller slit 6 functions to improve resolution in the X-ray measurement by restricting the divergence of X-rays diffracted by the specimen 'S'.

Figure 1:
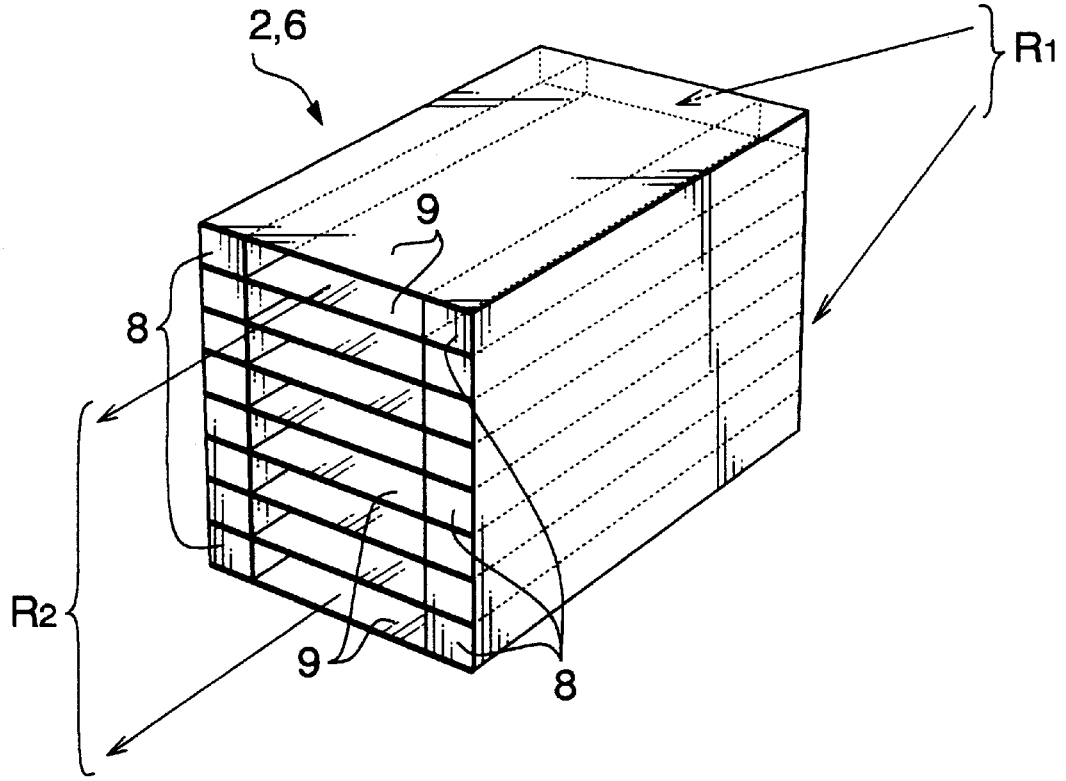
FIG. 1 is a perspective view of an embodiment of a soller slit according to the present invention.

In the focusing type optical system shown in FIG. 5 and in the parallel beam optical system shown in FIG. 6, the incident side soller slit 2 is formed by laminating a plurality of metal foils 9 with interposing spacers 8 as shown in FIG. 1. This is also true for the receiving side soller slit 6. When diverging incident X-rays R1 are incident on the soller slit 2 or 6, divergence thereof in a vertical direction is restricted, resulting in parallel X-rays R2 on the receiving side. By rotating the soller slit 2 or 6 by an angle of 90°, it is possible to obtain parallel X-ray beams having a width in the lateral direction.

Figure 2:
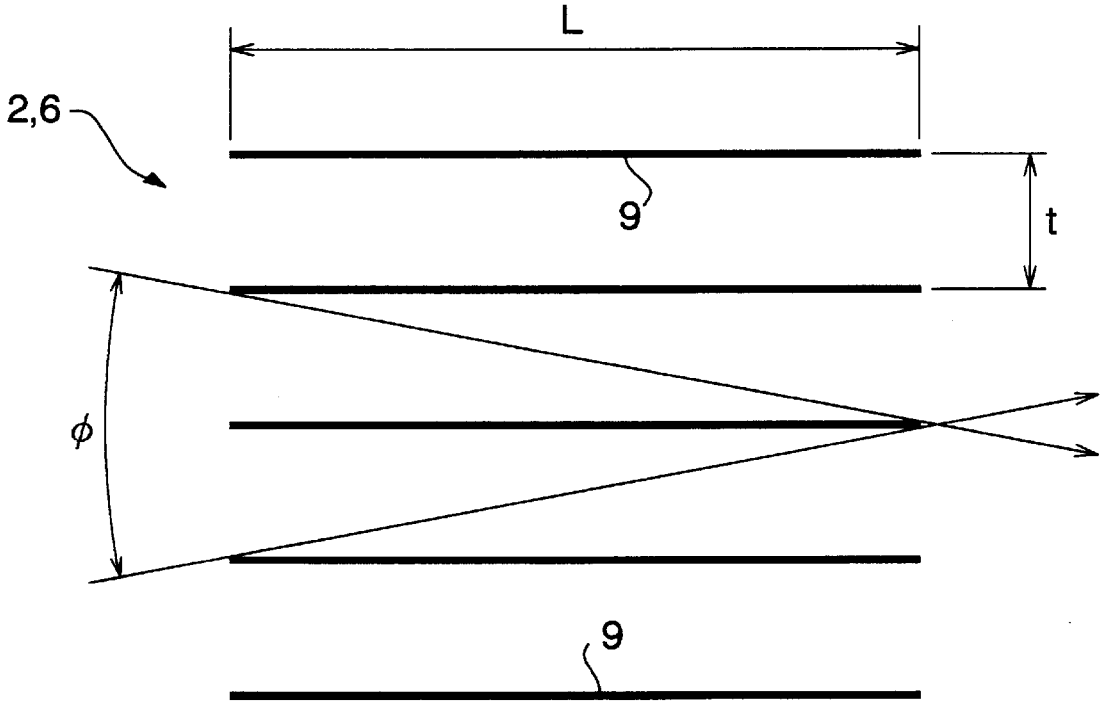
FIG. 2 illustrates an opening angle, which is an optical characteristic of the soller slit.

As one of the optical characteristics of the soller slit 2 and 6, there have been known an opening angle $\phi$ shown in FIG. 2, which is defined by the following formula:

$$\phi = 2 \times \tan^{-1}(t/L)$$

where "L" is a length of the metal foil 9 and "t" is a gap between adjacent metal foils 9. The opening angle $\phi$ is an important element for defining the resolution of the X-ray optical system utilizing the soller slit.

In this example, sintering a metal material such as tungsten (W) or molybdenum (Mo) forms the metal foils 9 of the soller slits 2 and 6. The total reflection of X-rays passing through the soller slits 2 and 6 is restricted by utilizing roughness of the surfaces of the metal foils, which is naturally provided by the sintering.

According to the currently usable sintering processing, it is possible to effectively form a desired high harmonic surface roughness, that is, surface roughness having space period of, for example, not larger than 50 μm, preferably 20~50 μm, and having RMS value of, for example 20 nm~1 μm, preferably 20~50 nm, on the material surfaces. The high harmonic surface roughness is very effective to restrict total reflection of X-rays. By restricting total refection of X-rays in this manner, it is possible to improve resolution in the X-ray measurement.

Alternatively, the metal foils 9 of the soller slits 2 and 6 may be formed by using oxidized stainless steal or brass (Cu: Zn=5: 1), with improved resolution of the X-ray measurement.

When stainless steal foil is oxidized, oxide material is formed on surfaces of the stainless steal foil, with which surface roughness having space period of, for example, not larger than 50 μm, preferably 20~50 μm, and having RMS value of, for example, 20 nm~1 μm, preferably 20~50 nm, can be effectively formed on surfaces of the stainless steal foil. The high harmonic surface roughness is very effective to restrict total reflection of X-rays as mentioned previously. By restricting total reflection of X-rays in this manner, it is possible to improve resolution in the X-ray measurement.

Embodiments of the soller slit according to the present invention will be described in detail.

First Embodiment

Metal foils 9 were prepared from tungsten plate formed by sintering and a soller slit 2 or 6 was fabricated by using the metal foils 9. Besides, metal foils 9 were prepared from a rolled stainless steal plate and a rolled brass plate. Further soller slits 2 or 6 of a prior art were fabricated by using the metal foils 9 and the brass foils 9, respectively.

Figure 3:
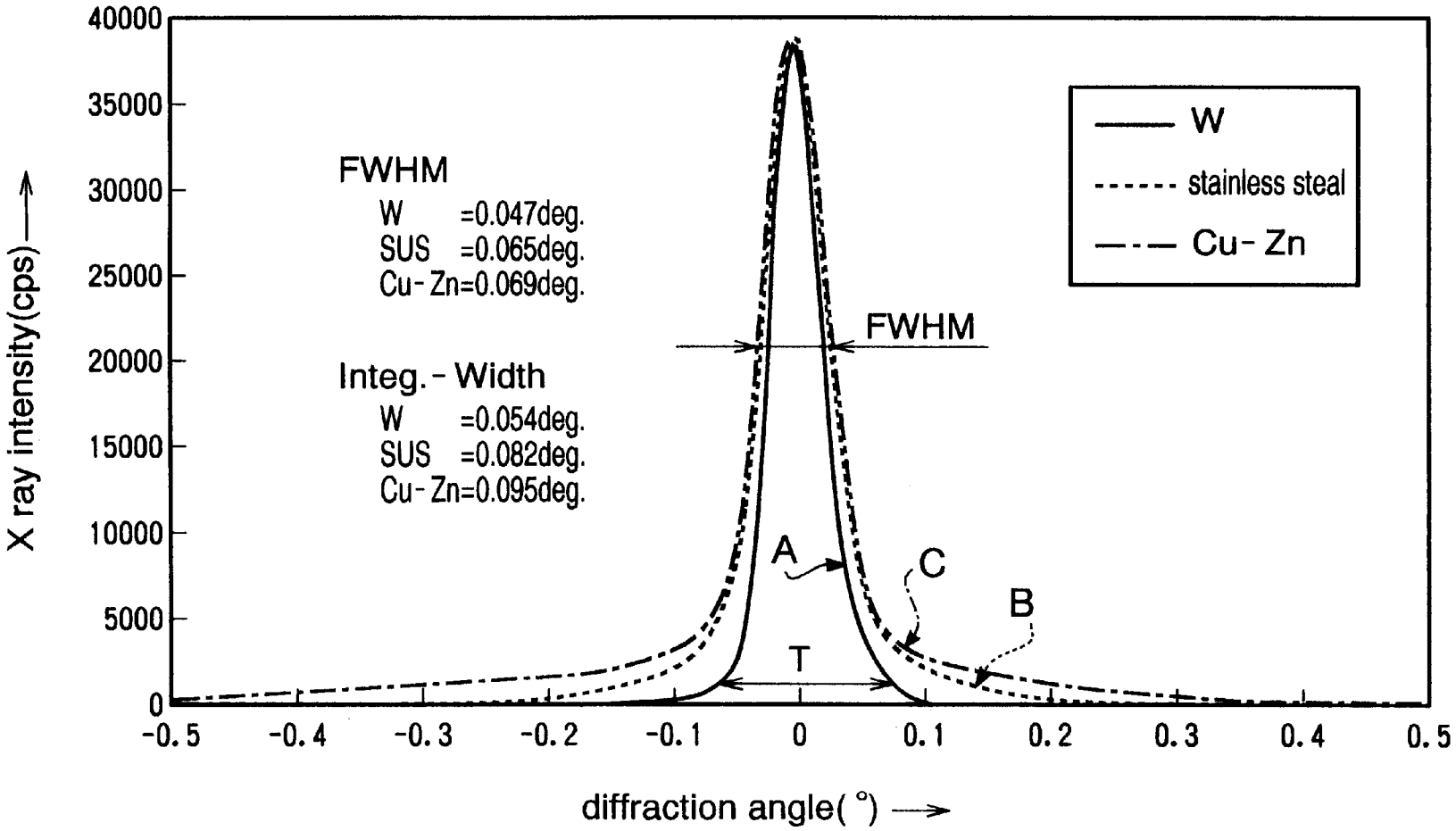
FIG. 3 shows an example of measurement result of an X-ray diffraction device using the soller slit.

FIG. 3 shows X-ray intensity vs. diffraction angle characteristics curves obtained X-ray measurement performed using X-ray optical systems constructed with using the respective three soller slits. In this measurement, a peak broadening that is defined by FWHM (full width of half-maximum) intensity and a tailing is investigated. Incidentally, the term "tailing" means a width of a bottom portion T in the characteristic curve shown in FIG. 3.

It was observed that the peak broadening was substantially smaller in the case (curve A) where the soller slit fabricated by sintering tungsten is used, compared with the cases where the soller slits fabricated by using the rolled stainless steal (curve B) and the rolled brass (curved C). This means that resolution when the soller slit fabricated by sintering tungsten is used is highest.

Second Embodiment

Figure 4:
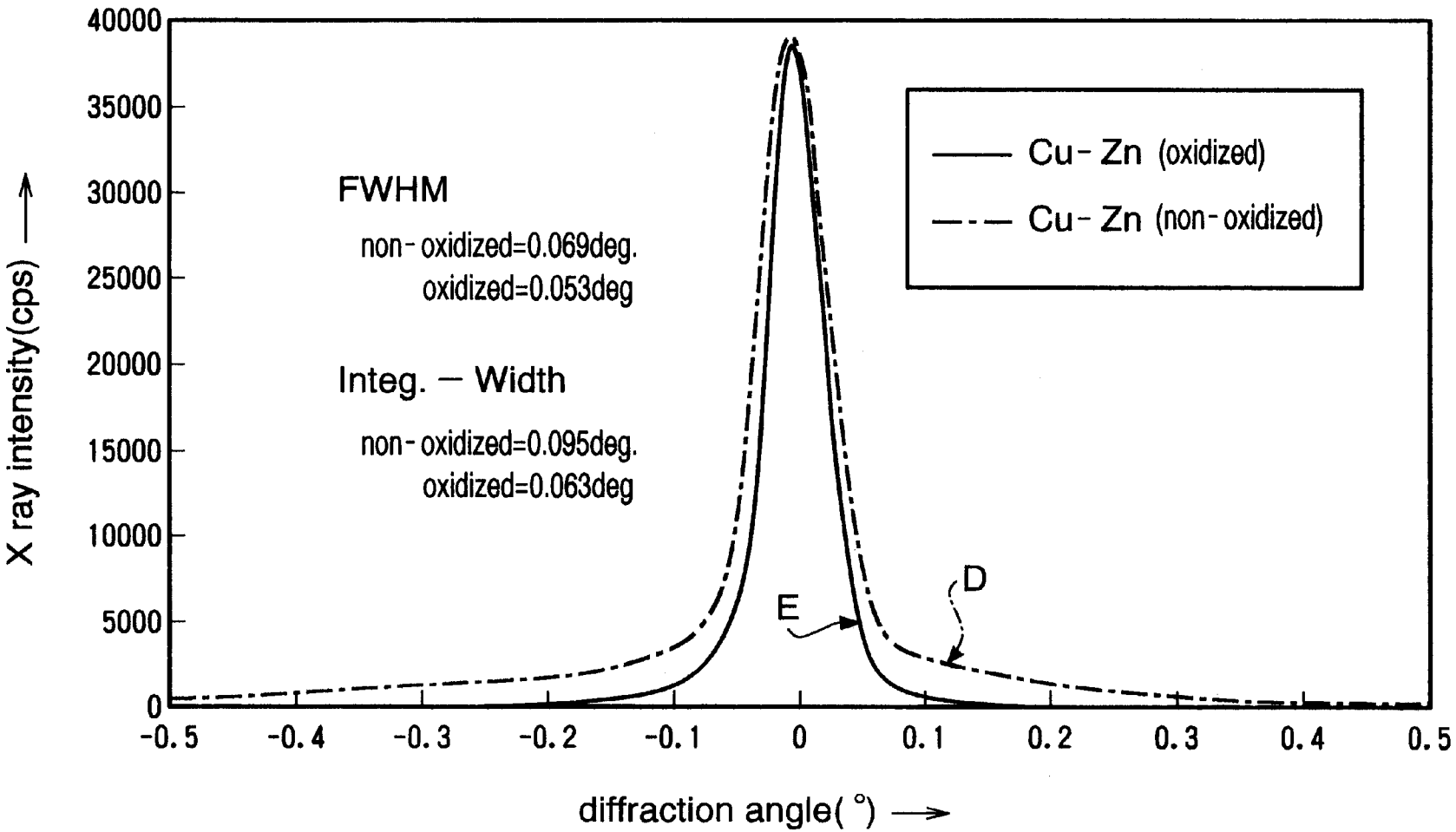
FIG. 4 shows another example of measurement result of an X-ray diffraction device using the soller slit.

Metal foils 9 shown in FIG. 1 were prepared by the conventional method utilizing a rolled brass (Cu: Zn=5: 1) and then, soller slits 2 and 6 were fabricated by using the metal foils 9. Subsequently, an X-ray measurement was performed with using an X-ray optical system constructed by using of the soller slits thus formed. FIG. 4 shows an X-ray intensity vs. diffraction angle characteristic curve D obtained by an X-ray measurement performed with using X-ray optical systems constructed by using of the soller slits.

Thereafter, the metal foils 9 of the soller slits 2 and 6 were disassembled from the latter and oxide material is formed on the surfaces of the metal foils 9 by oxidizing the latter with using dense nitric acid. Then, the oxidized metal foils 9 were re-assembled in the soller slits 2 and 6 and an X-ray measurement was performed with using thus re-assembled soller slits 2 and 6. The characteristic curve E shown in FIG. 4 is a result of the X-ray measurement.

As compared the characteristic curve E corresponding to the oxidized metal foils and the characteristic curve D corresponding to the metal foils which are not oxidized, it is clear that the characteristic curve E is superior to the characteristic curve D in the peak broadening specified with both FWHM value and tailing. That is, when the soller slits fabricated by using the oxidized metal foils are employed, resolution of the X-ray measurement can be improved substantially.

Other Embodiment

Although the present invention has been described with reference to the preferred embodiments, the present invention is not limited thereto and can be modified or changed variously within the scope of the present invention defined by the appended claims.

For example, the soller slit according to the present invention can be applied to other X-ray optical system than the X-ray optical system shown in FIGS. 5 and 6. Further, the structure of the soller slit is not limited to that shown in FIG. 1 and can be any structure provided that the metal foils are arranged with a predetermined space between adjacent ones. For example, the spacers are not always arranged on both sides of each metal foil. It is possible to arrange the spacer on one side of each metal foil.

What is claimed is:

1. A soller slit comprising a plurality of metal foils stacked with a constant interval between adjacent ones of said metal foils, said soller slit being arranged on an X-ray optical path to restrict divergence of X-rays, wherein each said metal foil being prepared by sintering a metal material such that surfaces thereof having high harmonic surface roughness.

2. A soller slit as claimed in claim 1, wherein the surface roughness has RMS value in a range from 20 nm to 1 μm, preferably from 20 to 50 nm.

3. A soller slit as claimed in claim 2, wherein said metal material is tungsten or molybdenum.

4. A soller slit as claimed in claim 1, wherein said metal material is tungsten or molybdenum.

5. A soller slit comprising a plurality of metal foils stacked with a constant interval between adjacent ones of said metal foils, said soller slit being arranged on an X-ray optical path to restrict divergence of X-rays, wherein oxide material is formed on both surfaces of each said metal foil by oxidizing said metal foil and said oxide material has high harmonic surface roughness.

6. A soller slit as claimed in claim 5, wherein the surface roughness has RMS value in a range from 20 nm to 1 μm, preferably from 20 nm to 50 nm.

7. A soller slit as claimed in claim 6, wherein said metal foils are formed from brass.

8. A soller slit as claimed in claim 5, wherein said metal foils are formed from brass.

9. A method for manufacturing a soller slit including a plurality of metal foils stacked with a constant interval between adjacent ones of said metal foils, said soller slit being arranged on an X-ray optical path to restrict divergence of X-rays, wherein said metal foils are prepared by sintering a metal material such that surfaces thereof have high harmonic surface roughness.

10. A method for manufacturing a soller slit including a plurality of metal foils stacked with a constant interval between adjacent ones of said metal foils, said soller slit being arranged on an X-ray optical path to restrict divergence of X-rays, wherein oxide material is formed on both surface of each said metal foil by oxidizing said metal foil and said oxide material has high harmonic surface roughness.

* * * * *